US005397760A

United States Patent [19]

Hutt

[11] Patent Number: 5,397,760

[45] Date of Patent: Mar. 14, 1995

[54] THERMAL TRANSFER PRINTING DYESHEET

[75] Inventor: Kenneth W. Hutt, Essex, England

[73] Assignee: Imperial Chemical Industries plc, London, England

[21] Appl. No.: 932,484

[22] Filed: Aug. 20, 1992

[30] Foreign Application Priority Data

Aug. 20, 1991 [GB] United Kingdom ..... 9117937

[51] Int. Cl.[6] ..... B41M 5/035; B41M 5/38

[52] U.S. Cl. ..... 503/227; 428/195; 428/913; 428/914; 430/200; 430/945

[58] Field of Search ..... 8/471; 428/195, 212, 428/913, 914; 503/227; 430/200, 270, 495, 945

[56] References Cited

U.S. PATENT DOCUMENTS 4,716,144 12/1987 Vanier et al. ..... 503/227

5,104,847 4/1992 Hann et al. ..... 503/227

5,147,843 9/1992 Bodem et al. ..... 503/227

FOREIGN PATENT DOCUMENTS 2083726 of 0000 United Kingdom ..... 503/227

*Primary Examiner*—B. Hamilton Hess

*Attorney, Agent, or Firm*—Cushman Darby & Cushman

[57] ABSTRACT

A dyesheet for light-induced thermal transfer printing comprises a substrate having on one side a dyecoat comprising a polymeric binder containing at least one thermal transfer dye dissolved or dispersed therein, an absorber coat of polymeric material comprising an absorber for the inducing light, and between the dyecoat and the absorber coat an interlayer of organic polymer through which the dye molecules diffuse less readily under printing conditions than they do through the dyecoat binder.

15 Claims, No Drawings

THERMAL TRANSFER PRINTING DYESHEET

The invention relates to light-induced thermal transfer printing, and in particular to dyesheets therefor.

Thermal transfer printing is a process for generating images by transferring dyes from a dyesheet to a receiver by application of heat. Such dyesheets comprise a substrate, usually a thin polymer film, coated on one side with a dyecoat containing one or more thermally transferable dyes. Printing is effected while holding the dyecoat against a receiver surface, and selected areas of the dyesheet are heated so as to transfer the dyes from those areas to the adjacent corresponding areas of the receiver, thereby generating the images according to the areas selected. Complex images can be built up from large numbers of very small pixels placed close together, and the resolution of the final image is determined by the number, size and spacing of such pixels.

Light-induced thermal transfer printers have a light source which can be focused on each area to be heated, in turn. Usually it is the light from such source that is caused to scan all the required areas on a stationary dyesheet, but in principle there is no reason why the dyesheet should not be caused to move in front of a stationary modulated light beam. By programming the printer to respond to electronic signals representing monochrome or full colour images (eg from a video, electronic Still camera or computer), hard copies of those images can be produced. The inducing light is usually selected to have a narrow wave band, which can be in the visible, ultra violet or infra-red regions, as such narrow wavebands can be finely focused more readily, and good laser sources of various wavelengths are available. Infra-red emitting lasers are particularly suitable. However, sources of much broader wavebands can be used for some applications.

To convert the inducing light into thermal energy for effecting transfer of the dye, the dyesheet contains a material which is an absorber for that light. This converts the light into heat at the point at which the light is incident, transferring dye molecules adjacent to that point to produce a single pixel at the corresponding position in the receiver. Where such dyesheets had the absorber material in the dyecoat itself, this minimized any loss of the generated heat between the absorber and dye molecules during printing, thereby maximizing sensitivity.

Absorber materials need to be selected according to the light source it is proposed to use, and various absorbers have been used or proposed, including for example dyes of a complementary colour to the inducing light, or a solid particulate material such as carbon black, which can absorb a broad spectrum of wavelengths. However, when such dyes are visibly coloured, and these or particulate absorbers such as carbon black, are located in the dyecoat itself, there is a danger that some may be carried over to the receiver during printing, to produce visible markings and thus detract from the print quality.

This has previously been recognized (eg as described in GB 2,083,726), and a generally preferred format is to secure the absorber in a further layer of the binder between the dyecoat and the substrate. Although this does remove the heat-generating source from its previous intimate mixture with the dyes to be transferred, it was found that the dyecoat, by providing a barrier layer over the absorber, could be effective in preventing transfer of the latter to the receiver. Unfortunately, this usually resulted in producing prints of noticeably lower optical density than those made with dyesheets in which the absorber is incorporated into the dyecoat, and such dyesheets were described as being less sensitive than the singly coated sheets. We have now developed a dyesheet for light-induced thermal transfer printing which substantially avoids such disadvantage of lower sensitivity, while continuing to secure the absorber in a subcoat.

According to the present invention, a dyesheet for use in light-induced thermal transfer printing wherein inducing light is absorbed to provide the thermal energy required for effecting transfer of dye from the dyesheet to a receiver, comprises a substrate having on one side a dyecoat comprising a polymeric binder containing at least one thermal transfer dye dissolved or dispersed therein, and between the dyecoat and the substrate an absorber coat comprising a material which is an absorber for the inducing light to convert it into the required thermal energy, characterized in that between the dyecoat and the absorber coat is provided an interlayer comprising a polymeric material which is different from that of the dyecoat binder and through which the dye molecules diffuse less readily under printing conditions than they do through the dyecoat binder.

The interlayer separating the dyecoat from the absorber coat has to be traversed by all the thermal energy generated in the latter, before that energy can be used to transfer dye from the dyecoat to the receiver. Nevertheless, we find that the overall effect of that interlayer is to improve the sensitivity rather than reduce it. The observable practical effect is that the maximum achievable optical density is greater when such interlayer is present, than when using the same binder material for both the absorber coat and dyecoat, but with no interlayer between them, ie in the manner of previously known light induced transfer dyesheets. At lower energy levels, the measured optical density of a print might be slightly less, but we have found any such reduction to be less noticeable to one viewing the print than the improvement due to the enhanced maximum achievable optical density that can be obtained using the dyesheet of the present invention.

One way of putting the present invention into practice, is to use for the interlayer a composition which is less compatible with the dyes than is the dyecoat binder. This causes dyes preferentially to travel towards the receiver during printing. Polymer compositions which generally have a low compatibility with thermal transfer dyes, include those which are more hydrophilic. Examples which contrast with polymers more commonly used for dyecoat binders, include vinyl alcohol/vinyl acetate copolymers, polyvinyl pyrrolidone, polyacrylic acid and water soluble celluloses.

An alternative is to make diffusion through the interlayer physically more difficult by using a polymer composition which is more highly crosslinked than the first polymeric binder of the dyecoat. Indeed, our preferred dyesheet is one in which the interlayer comprises a highly crosslinked organic polymer; and thus contrasts with normal dyecoat binders which are substantially uncrosslinked polymeric materials and thus readily permeable to the dye molecules. Highly crosslinked polymeric layers can be obtained as the reaction products of curing a layer of coating composition comprising a mixture of a reactive resin and a crosslinking agent having a plurality of functional groups reactive with the resin. Examples include epoxy resins, polyurethanes, and base or acid catalysed condensation reaction products, especially the latter.

Thus a preferred cross-linked material is the reaction product of a solvent-soluble compound having a plurality of reactive hydroxyl groups per molecule, and a crosslinking agent reactive with such hydroxyl groups, the functionality of one of these reactants being at least 2, and the functionality of the other being at least 3, thereby to produce a highly crosslinked polymer matrix.

Solvent-soluble polymeric compounds suitable for crosslinking as above include polyacrylic acid, polyvinylbutanol and terpolymers of vinyl acetate, vinyl chloride and vinyl alcohol, eg VROH terpolymers (Union Carbide). Suitable solvents for these have some polarity, but solvents should be chosen which are also solvents for the cross linking agent. Examples of generally useful solvents include acetone, diacetone alcohol (DAA) and isopropanol. The solvent-soluble compounds may also be selected from low molecular weight compounds such as polyalkylene glycols having terminal hydroxyl groups, eg polypropylene glycol and diethylene glycol.

Preferred crosslinking agents are polyfunctional N-(alkoxymethyl) amine resins having at least three alkoxymethyl groups per molecule which are available to react with the hydroxyl groups of the above solvent-soluble compounds. Such cross-linking agents include alkoxymethyl derivatives of urea, guanamine and melamine resins. Lower alkyl compounds (ie up to the butoxy derivatives) are available commercially and all can be used effectively, but the methoxy derivative is much preferred because of the greater ease with which its more volatile by-product (methanol) can be removed afterwards.

Examples of the latter which are sold by American Cyanamid in different grades under the trade name Cymel, are the hexamethoxymethylmelamines, suitably used in a partially prepolymerised (oligomer) form to obtain appropriate viscosities. Hexamethoxymethylmelamines are 3–6 functional, depending on the steric hindrance from substituents, and are capable of forming highly cross-linked materials using suitable acid catalysts, eg p-toluene sulphonic acid (PTSA). However, the acids are preferably blocked when first added, to extend the shelf life of the coating composition. Examples include amine-blocked PTSA (eg Nacure 2530) and ammonium tosylate.

Other barrier materials which can be used for the polymeric material of the interlayer, include crosslinked reaction products of polymerizing at least one organic compound having a plurality of radically polymerisable unsaturated groups per molecule. Our preferred interlayer by this route comprises the reaction product of radically polymerizing a layer of coating composition having the following constituents:

a) at least one organic compound having a plurality of radically polymerisable unsaturated groups per molecule, and at least one of b and c wherein
b) consists of at least one organic compound having a single radically polymerisable unsaturated group per molecule copolymerisable with a, and
c) consists of at least one linear organic polymer in amount within the range 1–20% by weight of the total amount of the radically polymerisable compounds of constituents a and b.

When the radically polymerisable groups have been copolymerised, the polyfunctional materials provide the binder with improving resistance to diffusion by the dye as the number of unsaturated groups per molecule increases, but this is at the expense of flexibility. It is to mitigate this lack of flexibility that we add the monofunctional comonomers and/or the linear polymer. However, we still prefer to restrict the bulk (at least 95% by weight) of our polyfunctional constituent a to compounds with only 2–8, preferably 2–6, radically polymerisable unsaturated groups per molecule.

Examples of polyfunctional compounds having just two radically polymerisable unsaturated groups per molecule and suitable for use as or as part of constituent a of this composition, include 1,6-hexandiol di(meth)acrylate (the designation "(meth)" being used herein to indicate that the methyl group is optional, i.e. referring here to both 1,6-hexandiol dimethacrylate and 1,6-hexandiol diacrylate), ethylene glycol di(meth)acrylate, diethylene glycol di(meth)acrylate, triethyleneglycol di(meth)acrylate, tetraethylene glycol di(meth)acrylate, polyethylene glycol di(meth)acrylate, tripropylene glycol di(meth)acrylate, polypropylene glycol di(meth)acrylate, and neopentyl glycol di(meth)acrylate.

Examples of compounds having three or more radically polymerisable groups and suitable for use as or as part of constituent a, include trimethylol propane tri(meth)acrylate, pentaerythritol tri(meth)acrylate, pentaerithritol tetra(meth)acrylate, and dipentaerythritol hexa(meth)acrylate. Other examples include compounds having three or more radically polymerisable groups corresponding to the di-functional compounds above, including esters of (meth)acrylic acid with polyester polyols and polyether polyols which are obtainable from a polybasic acid and a polyfunctional alcohol, urethane (meth)acrylates obtained through a reaction of a polyisocyanate and an acrylate having a hydroxy group, and epoxy acrylates obtained through a reaction of an epoxy compound with acrylic acid, an acrylate having a hydroxy group or an acrylate having a carboxyl group.

Examples of monofunctional compounds suitable for use in constituent b, i.e. compounds having a single radically polymerisable unsaturated group per molecule, include such aliphatic (meth)acrylates as 2-ethylhexyl (meth)acrylate and lauryl (meth)acrylate, such alicyclic (meth)acrylates as cyclohexyl (meth)acrylate, isobornyl (meth)acrylate, dicyclopentanyl (meth)acrylate, and dicyclopentadienyl (meth)acrylate, such alkoxyalkylene glycol (meth)acrylates as methoxydiethylene glycol acrylate, and ethoxydiethylene glycol acrylate, such aromatic (meth)acrylates as phenyl acrylate, and benzyl acrylate, and such (meth)acrylates of aliphatic alcohols as 2-hydroxyethyl (meth)acrylate, and 2-hydroxyethyl di(meth)acrylate. Of these, compounds having at least one alicyclic group per molecule are particularly favoured because of their low shrinkage characteristics. We also find that they can provide a surprising degree of resistance to migration of the dye from dyecoat to interlayer during storage.

Where an organic compound having a single radically polymerisable unsaturated group per molecule, ie constituent b, is present, we prefer to have an excess of constituent a over constituent b to maintain a high resistance to dye diffusion therethrough, our preferred composition having the polymerisable constituents a and b in the proportions 50–90% of a and correspondingly 50–10% of b, by weight.

Preferred linear polymers of constituent c are polymethyl methacrylate, polyvinyl chloride, linear polyesters and acrylated polyester polyols. Examples include Diakon LG156 polymethylmethacrylate and Corvic CL440 vinyl chloride/vinyl acetate copolymer (both from ICI plc), Ebecryl 436 linear polyester (supplied as a 40% solution trimethylolpropane triacrylate by UCB) and Synacure 861X hydroxyfunctional acrylated polyester. All of these consist of linear molecules essentially free from functional acrylic groups, and are believed to remain entwined in the crosslinked matrix but not chemically bonded to it.

In order to make such a crosslinked interlayer, a coating composition of the absorber dissolved or dispersed within the solution containing the polymerisable moieties, is applied as a layer onto the substrate and any solvent removed by drying. The resultant dry layer is then cured by heating or by irradiating with electromagnetic (eg ultraviolet) radiation. In addition to the above mentioned radically polymerisable compounds, this coating composition includes solvents and radical polymerization initiators, as required to complete.

Suitable solvents include alcohols, ketones, esters, aromatic hydrocarbons, and halogenated hydrocarbons. The quantity of solvent required is that which provides a solution viscosity having good coating characteristics.

Examples of suitable radical polymerization initiators, include benzophenone, benzoin, such benzoin ethers as benzoin methyl ether and benzoin ethyl ether, such benzyl ketals as benzyl dimethyl ketal, such acetophenones as diethoxy acetophenone and 2-hydroxy-2-methyl propiophenone, such thioxanthones as 2-chloro-thioxanthones and isopropyl-thioxanthone, such anthraquinones as 2-ethyl-anthraquinone and methylanthraquinone (the above normally being in the presence of an appropriate amine, eg Quantacure ITX (a thioxanthone) in the presence of Quantacure EPD (an aromatic amine), both from Ward Blenkinsop), such azo compounds as azobisisobutyronitrile, such organic peroxides as benzoyl peroxide, lauryl peroxide, di-t-butyl peroxide, and cumyl peroxide. Other examples of commercially available systems include Igacure 907 from Ciba Geigy, and Uvecryl P101 from UCB. The quantity of these radical polymerization initiators used in the polymerization is 0.01–15% by weight of the aforementioned radically polymerisable compounds.

Other additives may also be incorporated into the coating solution, to improve further its coating characteristics, for example.

Various coating methods may be employed, including, for example, roll coating, gravure coating, screen coating and fountain coating. After removal of any solvent, the coating can be cured by heating or by irradiating with electromagnetic radiation, such as ultraviolet light, electron beams and gamma rays, as appropriate. Typical curing conditions are heating at 50°–150° C. for 0.5–10 minutes (in the case of thermal curing), or exposure to radiation for 1–60 s from an ultraviolet lamp of 80 W/cm power output, positioned about 15 cm from the coating surface (in case of ultraviolet light curing). In-line UV curing may utilize a higher powered lamp, eg up to 120 W/cm power output, focused on the coating as it passes the lamp in about 0.1–10 ms. The coating is preferably applied with a thickness such that after drying and curing the thickness is 0.1–5 μm, preferably 0.2–3 μm, and will depend on the concentration of the coating composition.

The dyecoat is formed by coating the interlayer with an ink prepared by dissolving or dispersing one or more thermal transfer dyes and a binder resin to form a coating composition; then removing any volatile liquids. Any dye capable of being thermally transferred in the manner described above, may be selected as required. Dyes known to thermally transfer, come from a variety of dye classes, e.g. from such nonionic dyes as azo dyes, anthraquinone dyes, azomethine dyes, methine dyes, indoaniline dyes, naphthoquinone dyes, quinophthalone dyes and nitro dyes. The dyecoat binder can be selected from such known polymers as polycarbonate, polyvinylbutyral, and cellulose polymers, such as methyl cellulose, ethyl cellulose and ethyl hydroxyethyl cellulose, for example, and mixtures of these. A preferred dyecoat is one comprising one or more thermally transferable dyes dispersed throughout a polymeric binder comprising a mixture of polyvinylbutyral and cellulosic polymer, wherein the percentage by weight of polyvinylbutyral in the mixture lies within the range 65–85%, the range 70–85% being particularly preferred.

The ink may also include dispersing agents, antistatic agents, antifoaming agents, and oxidation inhibitors, and can be coated onto the interlayer as described for the formation of the latter. The thickness of the dyecoat is suitably 0.1–5 μm, preferably 0.5–3 μm.

The absorber coat lying between the substrate and the interlayer, comprises a material which is an absorber for the inducing light to convert it into the required thermal energy, but being laid down in the form of a coating, we prefer that the composition also comprises a polymeric material. Whereas the polymeric material may inherently absorb or be adapted to absorb the inducing light (eg by having an absorber chemically attached to it), we generally prefer an absorber coat in which the polymeric material provides a second polymeric binder in which the absorber is dissolved or dispersed, as this enables both the absorber and the second polymeric binder independently to be selected for the task each has to perform.

Our preferred absorber is carbon black, as this provides good absorption and conversion to heat, of a broad spectrum of wavelengths, and hence is not critical to the inducing light source employed for the printing. It is also relatively cheap, and in the present dyesheets is well protected against inadvertent transfer by the two overlying layers. Particulate graphite can similarly be used as a broad band absorber.

For lasers operating in the near infrared, there are also a number of organic materials known to absorb at the laser wavelengths. Examples of such materials include the substituted phthalocyanines described in EP-B-157,568, which can readily be selected to match laser diode radiation at 750–900 nm, for example.

Also of importance is the provision of sufficient absorber for the system used. It is desirable to use sufficient to absorb at least 50% of the incident inducing light. We prefer to use sufficient to absorb at least 90% of the inducing light, to obtain an optical density of 1 in transmission, although higher proportions may be used if desired.

The absorber is applied to the substrate before the interlayer, in the form of a coating composition which is then dried before the interlayer is added. The method of applying such coatings can be selected from any of those described above for the interlayer. We prefer to use polymeric materials such as those described above for the first binder of the dyecoat, none of which require crosslinking. However, the use of crosslinkable resins and the provision of a crosslinking stage in the manufacture of the absorber layer, can be useful for preventing redissolving of the dried but uncrosslinked absorber layer materials by some solvents which may be used in the interlayer coating composition that will later overlie it.

A variety of materials can be used for the substrate, including transparent polymer films of polyesters, polyamides, polyimides, polycarbonates, polysulphones, polypropylene and cellophane, for example. Biaxially orientated polyester film is the most preferred, in view of its mechanical strength, dimensional stability and heat resistance. The thickness of the substrate is suitably 1–50 μm, and preferably 20–30 μm.

The dyesheet may be elongated in the form of a ribbon and housed in a cassette for convenience, enabling it to be wound on to expose fresh areas of the dyecoat after each print has been made.

Dyesheets designed for producing multicolour prints have a plurality of panels of different uniform colours, usually three: yellow, magenta and cyan, although the provision of a fourth panel containing a black dye, has also previously been suggested. When supported on a substrate elongated in the form of a ribbon, these different panels are suitably in the form of transverse panels, each the size of the desired print, and arranged in a repeated sequence of the colours employed. During printing, panels of each colour in turn are held against a dye-receptive surface of the receiver sheet, as the two sheets are imagewise selectively irradiated to transfer the dye selectively where required, the first colour being overprinted by each subsequent colour in turn to make up the full colour image.

Although the present invention provides interlayer barriers through which the dye molecules diffuse less readily under printing conditions, such barriers can be advantageous for both dye diffusion printing and sublimation printing. The former can be procured by bringing the dyecoat and receiver surfaces into intimate contact, whereby the dye molecules can diffuse directly from the dyecoat into the receiver. For maximized optical densities we prefer that for each of these surfaces the average roughness shall be less than 0.2 μm, especially less than 0.15 μm (the average roughness being the arithmetic average of all departures of the roughness profile from a center line). For such smooth surfaces, pressures of about 1 atmosphere are then sufficient to provide intimate contact between them. Sublimation printing occurs in the vapour phase, and hence requires a small air gap between the surfaces to enable the dye molecules to sublime across. This can be useful for printing rough receivers with sublimable dyes, but may require a further heating step to enable the dyes to penetrate the receiver and be less prone to removal by wiping. Thus generally we prefer that the dyecoat and receiver are provided with smooth surfaces which are pressed into intimate contact during printing.

EXAMPLE 1

The invention will now be illustrated by a specific example of a dyesheet prepared according to the invention (Dyesheet 1), reference also being made to a dyesheet without an interlayer (Dyesheet 2), prepared for purposes of comparison.

Both dyesheets were based on a substrate of 6 μm polyester film. Dyesheet 1, was prepared by coating the substrate with a layer of infra-red absorbing composition, which was dried to form an absorber coat. An interlayer according to the present invention was then provided over the absorber coat, and finally a dyecoat was added to overlie the interlayer. The other dyesheet, Dyesheet 2, was prepared in similar manner except that the interlayer was omitted.

The polymers used as a basis for preparing all five coatings were the same, these being a mixture of polyvinylbutyral ("PVB"—grade BX-1 from Hercules being used) and ethyl cellulose ("EC"—grade T10 from Sekisui), being used in the quantities set out below. In the crosslinked interlayer, a crosslinking agent and catalyst were also added, these being a hexamethoxymethylmelamine oligomer (Cymel 303 from American Cyanamid) and an amine-blocked p-toluene sulphonic acid ("PTSA") respectively. The infra-red absorber used in this series was a substituted phthalocyanine dye.

The formulations of the coating compositions used were as follows:

| Infra-red absorbing subcoat composition: | |
|---|---|
| infra-red absorber | 0.28 g |
| PVB | 2.00 g |
| EC | 0.50 g |
| THF | 30.58 g |

This composition was spread onto the substrate using a No 2 Meyer K bar, to give a 12 μm wet coat, then dried to give an approximately 1 μm dry absorber coat.

| Interlayer coating composition: | |
|---|---|
| PVB | 2.00 g |
| EC | 0.50 g |
| Cymel 303 | 2.45 g |
| PTSA | 0.05 g |
| THF | 55.0 g |

The PTSA catalyst was added to the remainder of the composition just before coating. The catalysed composition was then spread onto the dry absorber coat using a No 2 Meyer K-bar to give a 12 μm wet layer, and dried to give an approximately 1 μm dry coat. This was then cured in a 140° C. oven for 3 minutes.

| Dyecoat composition: | |
|---|---|
| thermal transfer dye 1 | 0.86 g |
| thermal transfer dye 2 | 0.21 g |
| PVB | 0.95 g |
| EC | 0.24 g |
| THF | 24.74 g |

where thermal transfer dye 1 was CI Disperse Red 60, and thermal transfer dye 2 was 3-methyl-4-(3-methyl-4-cyanoisothiazol-5-ylazo)-N-ethyl-N-acetoxyethylaniline.

This composition was applied over the interlayer of Dyesheet 1, and over the absorber coat of Dyesheet Cl, using a No 3 K-bar to give a 24 μm wet coat in each case, then dried to give an approximately 2 μm dry coat.

The two dyesheets were placed against transparent dye diffusion receivers having smooth receiver coat surfaces of average roughness less than 0.04 μm (being the arithmetic average of all departures of the roughness profile from the center line within an evaluation length, this being 5.6 mm for the above measurement made using a Perthometer). The dyecoats and adjacent receiver coats were pressed into intimate contact by the application of 1 atmosphere of pressure. An STC LT-100 laser diode operating at 807 nm was collimated and then focused using a 160 mm achromat lens. The incident laser power at the dyesheet was about 60 mW and the laser spot size (full width at half power maxima) was about 30 μm×20 μm.

The laser spot was scanned by a galvanometer scanner. The dyesheet and receiver sheet were held on an arc which allowed focus to be retained throughout the scan length. The laser addressed spots 20 μm by 10 μm apart giving a substantial overlap to adjoining spots. At each spot the laser was pulsed at 60 mW for a varying time (thus controlling the energy applied) and the optical density of the transferred dye was measured. The transmission optical densities recorded in the receiver sheet for images from the two dyesheets at two energy levels, were as follows.

TABLE 1

| Transmission optical densities | | |
|---|---|---|
| | LASER PULSE LENGTH | |
| DYESHEET | 250 μs | 550 μs |
| 1 | 0.11 | 1.26 |
| 2 | 0.21 | 0.82 |

The slight reduction at very low energy levels, referred to above, is clearly shown in these results, but such a reduction at these levels is not important, as the change is very gradual. What is a much more important factor in determining the visual impact of the final print, is the beneficial increase in the maximum achievable optical density, that the above results show can be obtained by adding an interlayer according to the present invention.

EXAMPLE 2

This Example is provided to show the effect of one or other of the dyesheet and receiver surfaces having less than ideal smoothness. When dyesheets have undercoats filled with particulate materials it becomes more difficult to obtain a consistant graded roughness series extending to preferred smoothness levels. Accordingly, the effect of varying the roughness is shown below by using a series of receivers of varying roughness with a standard dyesheet, and different dyesheets have been prepared to show how variations in their smoothness can occur, even using the same dyecoat composition for each.

Receivers were prepared as follows:

Receiver 1. This was a standard thermal transfer receiver: a transparent grade of Melinex (ICI plc's polyester film) was coated with a polymer receiver solution, dried and cured.

Receivers 2–5. A substrate of the same grade of Melinex was coated with the same polymeric receiver composition as in Receiver 1, but to which had been added 0.1%, 1%, 5%, and 10% w/w solids of 20 μm glass beads respectively.

Dyesheets were prepared as follows:

A dyecoat coating composition was prepared with the following formulation:

Magenta dye 0.833 g
PVB (BX1) 0.444 g
EC (T10) 0.111 g
THF 11.1 g wherein the magenta dye was 3-methyl-4-(3-methyl-4-cyanoisothiazol-5-ylazo)-N-ethyl-N-acetoxyethylaniline. This composition was coated as specified below using a No.2 meyer bar, and dried to give a dry coat thickness of 1.5 μm.

Dyesheet 3. The dyecoat composition was coated onto a 23 μm thick transparent filled grade of Melinex.

Dyesheet 4. The dyecoat composition was hand coated onto a sub-coated 6 μm polyester film which also had a previously applied backcoat.

Dyesheet 5. The dyecoat composition was gravure coated onto a pre-coated 6 μm polyester film like that of Dyesheet 4.

Dyesheet 6. The dyecoat composition was coated onto an absorber coat of carbon black in a cross-linked binder of UV-cured acrylic polymer, previously coated onto a 23 μm thick transparent filled grade of Melinex.

Roughness measurements were made on the above receiver coats and the dyecoats using a Perthometer. These are expressed below in terms of the average roughness (Ra); defined as the arithmetic average of all departures of the roughness profile from the center line within the evaluation length. In each case the evaluation length was 5.6 mm. The values given in Table 2 below are the mean values, Ra(m), of the average roughness over 3 traces.

TABLE 2

| Roughness measurements (μm) | |
|---|---|
| | Ra (m) |
| Receiver 1 | 0.037 |
| Receiver 2 | 0.064 |
| Receiver 3 | 0.081 |
| Receiver 4 | 0.297 |
| Receiver 5 | 0.595 |
| Dyesheet 3 | 0.086 |
| Dyesheet 4 | 0.292 |
| Dyesheet 5 | 0.298 |
| Dyesheet 6 | 0.119 |

To demonstrate what effect surface roughness might have on a print made by laser induced transfer, all five receivers were printed as described above in Example 1 above, using Dyesheet 6 in each case. The laser pulse time was varied, and the optical density build up measured. The results of this exercise are given in Table 3 below.

It can be seen that as the level of roughness of the receiver surface is increased, the maximum optical density that can be obtained in the receiver is reduced. In addition, we also found that where high levels of roughness (Receivers 4 & 5) are employed in the receiver layer, dye sublimation occurs indicated by the fact that dye collects as crystals on the surface of the receiver and can be wiped off. This problem becomes particularly noticeable when either of the contacting surfaces has an average roughness above 0.2 μm, and we prefer that both surfaces have roughness values less than 0.15 μm.

TABLE 3

| Optical density measurements made in reflection using a Sakura densitometer. | | | | | |
|---|---|---|---|---|---|
| LASER PULSE | RECEIVER | | | | |
| TIME (μs) | 1 | 2 | 3 | 4 | 5 |
| 50 | 0.2 | 0.16 | 0.18 | 0.18 | 0.14 |

TABLE 3-continued

| Optical density measurements made in reflection using a Sakura densitometer. | | | | | |
|---|---|---|---|---|---|
| LASER PULSE | RECEIVER | | | | |
| TIME (μs) | 1 | 2 | 3 | 4 | 5 |
| 100 | 0.29 | 0.3 | 0.23 | 0.24 | 0.24 |
| 150 | 0.64 | 0.62 | 0.61 | 0.60 | 0.61 |
| 200 | 1.14 | 1.05 | 1.12 | 1.12 | 1.12 |
| 250 | 1.69 | 1.50 | 1.57 | 1.48 | 1.42 |
| 300 | 2.14 | 1.73 | 1.86 | 1.80 | 1.43 |
| 350 | 2.30 | 2.17 | 2.06 | 1.94 | 1.54 |
| 400 | 2.36 | 2.26 | 2.26 | 2.02 | 1.57 |
| 450 | 2.43 | 2.32 | 2.40 | 1.87 | 1.73 |
| 500 | 2.38 | 2.32 | 2.50 | 1.97 | 1.68 |
| 550 | 2.36 | 2.32 | 2.47 | 1.89 | 1.64 |

I claim:

1. A dye sheet for use in light-induced thermal transfer printing wherein inducing light is absorbed to provide the thermal energy required for effecting transfer of dye from the dyesheet to a receiver, comprising a substrate, a dyecoat on one side of the substrate comprising a polymeric binder containing at least one thermal transfer dye dissolved or dispersed therein, an absorber coat between the dyecoat and the substrate comprising a polymeric material and a material which is an absorber for the inducing light to convert it into the required thermal energy, and an interlayer between the dyecoat and the absorber coat comprising a hydrophilic polymer or crosslinked polymer which is different from that of the dyecoat binder and through which the dye molecules diffuse less readily under printing conditions than they do through the dyecoat binder, said dyecoat having a smooth surface for contact with a receiver having a smooth surface such that, when the dyesheet is used in a process of light-induced thermal transfer printing, the smooth surface of the dyecoat and the receiver are pressed into intimate contact during printing, whereby the heated dye molecules can diffuse directly from the dyecoat into the receiver.

2. A dyesheet as claimed in claim 1 wherein the dyecoat binder is a substantially uncrosslinked polymeric material permeable to the dye molecules, and the polymeric material of the interlayer comprises a crosslinked organic polymer.

3. A dyesheet as claimed in claim 2 wherein the crosslinked material is the reaction product of a solvent-soluble compound having a plurality of reactive hydroxyl groups per molecule, and a crosslinking agent reactive with such hydroxyl groups, the functionality of one of these reactants being at least 2, and the functionality of the other being at least 3, thereby to produce a highly crosslinked polymer matrix.

4. A dyesheet as claimed in claim 3 wherein the crosslinking agent is a polyfunctional N-(alkoxymethyl) amine resin having at least three alkoxymethyl groups per molecule which are available to react with the hydroxyl groups of the above solvent-soluble compounds.

5. A dyesheet as claimed in claim 2 wherein the interlayer comprises crosslinked reaction products of polymerizing at least one organic compound having a plurality of radically polymerisable unsaturated groups per molecule.

6. A dyesheet as claimed in claim 5 wherein the interlayer comprises the reaction product of radically polymerizing a layer of coating composition having the following constituents:

a) at least one organic compound having a plurality of radically polymerisable unsaturated groups per molecule, and at least one of b and c wherein b) consists of at least one organic compound having a single radically polymerisable unsaturated group per molecule copolymerisable with a, and c) consists of at least one linear organic polymer in amount within the range 1–20% by weight of the total amount of the radically polymerisable compounds of constituents a and b.

7. A dyesheet as claimed in claim 1, wherein the absorber comprises carbon black.

8. A dyesheet as claimed in claim 1, wherein the absorber comprises an organic material which absorbs light in the near infra-red wave band of 750–900 nm.

9. A dyesheet as claimed in claim 1, wherein the dyecoat binder and interlayer are both substantially transparent to the inducing light.

10. A dyesheet as claimed in claim 1, wherein the thickness of the substrate is 20–30 μm.

11. A dyesheet as claimed in claim 1, wherein the dyesheet has a dyecoat surface with an average roughness of less than 0.2 μm.

12. A dyesheet as claimed in claim 11, wherein the dyesheet has a dyecoat surface with an average roughness of less than 0.15 μm.

13. A dyesheet as claimed in claim 1, wherein the substrate has an elongated ribbon shape, and the dyecoat comprises a plurality of different coloured dyes dispersed in binders to form coloured panels arranged as a repeated sequence along the length of the ribbon, each sequence containing a uniform panel of each colour overlying an interlayer comprising a polymeric material through which the dye molecules diffuse less readily under printing conditions than they do through the polymeric binder of the dyecoat panel.

14. In combination, a dyesheet according to claim 1 and a receiver, the dyecoat and receiver having smooth cooperating surfaces so that when the dyecoat and receiver are used in a process of light-induced thermal transfer printing, the dyecoat and receiver may be pressed into intimate contact during printing, whereby the heated dye molecules can diffuse directly from the dyecoat into the receiver.

15. A process of light-induced thermal transfer printing which comprises placing the surface of the dyecoat of a dyesheet according to claim 1 in intimate contact with a smooth receiving surface of a receiver and diffusing dye from the dyecoat directly into the receiver by light-induced thermal heat transfer.

* * * * *